US007152634B2

(12) United States Patent
Peters et al.

(10) Patent No.: US 7,152,634 B2
(45) Date of Patent: Dec. 26, 2006

(54) METHOD FOR REMOVING WIRES OR TAPES FROM PRESSED BALES OF RAW MATERIAL AND WIRE COILING DEVICE FOR CARRYING OUT THE METHOD

(75) Inventors: Erich Peters, Euskirchen (DE); Eduard Gabanski, Euskirchen (DE); Alfred Pickel, Euskirchen (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 11/086,437

(22) Filed: Mar. 23, 2005

(65) Prior Publication Data

US 2005/0199310 A1 Sep. 15, 2005

Related U.S. Application Data

(63) Continuation of application No. PCT/EP03/09324, filed on Aug. 22, 2003.

(30) Foreign Application Priority Data

Sep. 24, 2002 (DE) ..... 102 44 382

(51) Int. Cl.
*B23P 19/00* (2006.01)

(52) U.S. Cl. ..... 140/102; 29/564.3

(58) Field of Classification Search ..... 140/102; 83/909; 29/564.3

See application file for complete search history.

(56) References Cited

U.S. PATENT DOCUMENTS

| | | | | |
|---|---|---|---|---|
| 4,261,395 | A | 4/1981 | Gronau | |
| 4,835,836 | A * | 6/1989 | van Uitert | 29/564.3 |
| 5,297,329 | A * | 3/1994 | Santin et al. | 29/564.3 |

FOREIGN PATENT DOCUMENTS

| | | |
|---|---|---|
| CA | 1313991 | 3/1993 |
| DE | 2821336 | 10/1979 |
| EP | 0976657 | 2/2000 |
| SE | 454978 | 6/1988 |
| WO | 97/45325 | 12/1997 |

* cited by examiner

*Primary Examiner*—Lowell A. Larson
(74) *Attorney, Agent, or Firm*—Greenblum & Bernstein, P.L.C.

(57) ABSTRACT

Method and device for removing wires or tapes from pressed bales of raw material, in which the wires or tapes are arranged to form at least one point of intersection on at least two opposite bale sides. The method includes bringing the bales into an unwiring position, automatically determining a position of the at least one point of intersection, positioning a coiling device over the at least one point of intersection, severing the wires or tapes, and removing the wires or tapes from the bale by coiling the wire or tapes. The instant abstract is neither intended to define the invention disclosed in this specification nor intended to limit the scope of the invention in any way.

23 Claims, 2 Drawing Sheets

METHOD FOR REMOVING WIRES OR TAPES FROM PRESSED BALES OF RAW MATERIAL AND WIRE COILING DEVICE FOR CARRYING OUT THE METHOD

CROSS-REFERENCE TO RELATED APPLICATIONS

The present application is a Continuation of International Patent Application No. PCT/EP2003/009324 filed Aug. 22, 2003 and claims priority under 35 U.S.C. §119 of German Patent Application No. 102 44 382.3 filed Sep. 24, 2002. Moreover, the disclosure of International Patent Application No. PCT/EP2003/009324 is expressly incorporated by reference herein in its entirety.

BACKGROUND OF THE INVENTION

1. Field of the Invention

The invention relates to a method for removing wires or tapes from pressed bales of raw material, in which the wires or tapes are applied so that they form at least one each point of intersection on at least two opposite bale sides, and to a wire coiling device for removing wires or tapes from pressed bales of raw material.

2. Discussion of Background Information

Methods and devices of this type are used, e.g., in the paper industry. Often the raw material for paper production, i.e., cellulose or recovered paper, is namely supplied in pressed bales that are held together by wires or tapes. Such wires or tapes usually have to be removed before the raw materials are then processed into an aqueous suspension, e.g., in a pulper. Although this can also be done manually, it is dangerous and complicated. Methods of the type mentioned here have therefore been developed, with the aid of which the removal of wires and tapes can take place automatically. Coiling devices that can be used for such methods are known, e.g., from DE 28 21 336 C2. An important requirement of such methods is a cycle rate being as high as possible for the unwiring, i.e., that as many bales as possible should be processed, e.g., per hour. The unwiring station with a plurality of devices is very expensive, so it should be used in an optimal manner.

SUMMARY OF THE INVENTION

The present invention improves the methods of the type mentioned such that the removal of wires or tapes from paper or cellulose bales can be made even quicker.

According to the invention, the method includes bringing the bales into an unwiring position via a bale positioning device, determining a position of the wires automatically with a wire finder and positioning a wire coiling device over the wire, severing the wires or tapes, and removing the wires or tapes from the bale by at least one wire coiling device. The position of the point of intersection is automatically determined on at least one bale side and transmitted to a machine control unit which guides the wire coiling device to this point of intersection.

Further, the invention relates to a coiling device for coiling up and removing cut crossed bale wires with a centrally arranged hollow cylindrical reel rotor that has at least two helical slits starting from the work end of the reel rotor and penetrating the cylinder wall. A stator, which encloses this reel rotor, has at least two helical wire guide slits likewise starting from its work end and running opposite to the slits of the reel rotor. The reel rotor is continued in a drive shaft embodied or formed as a hollow shaft, in which drive shaft a wire ejector is located. The stator is provided with at least four wire guide slits which are evenly distributed in the circumferential direction and can make a rotary movement relative to the bale of at least 10° and no more than 99°, preferably 10–60°, and this rotary movement is to be made in the opposite direction of the rotary movement of the reel rotor.

Since in implementing the method the points of intersection of the wires or tapes can be chosen in order to place the wire coiling device there, it is possible to grip and remove two wires simultaneously during each coiling operation with the same wire coiling device. The method can be automated and is therefore particularly cost-effective.

The present invention is directed to a method for removing wires or tapes from pressed bales of raw material, in which the wires or tapes are arranged to form at least one point of intersection on at least two opposite bale sides. The method includes bringing the bales into an unwiring position, automatically determining a position of the at least one point of intersection, positioning a coiling device over the at least one point of intersection, severing the wires or tapes, and removing the wires or tapes from the bale by coiling the wire or tapes.

According to a feature of the invention, the method can include transmitting the determined position of the point of intersection to a machine control unit. The machine guide devices can guide the coiling device to the point of intersection.

The method may also include automatically determining the position of the wires or tapes with a wire finder.

In accordance with another feature of the invention, the bales can be brought into the unwiring position via a bale positioning device.

According to still another feature of the instant invention, the determining of the position of the point of intersection can include scanning the corresponding side of the bale with an automatic camera.

In accordance with another feature of the invention, the coiling device can be attached to a telescopic device and a pivoting device, which are driven by the machine control unit.

Moreover, the positions of the points of intersection on the upper side of the bale may be determined.

According to the invention, the wires or tapes may be severed by cutting devices. Further, the method can include positioning the cutting devices in a cutting position according to the position of the points of intersection. The cutting position can be established so that a length of the wires or tapes, starting from the coiling point predetermined from the machine control unit, is approximately the same.

According to another feature of the present invention, two coiling devices can be used and the process may further include dividing an outer surface of the bale into two partial surfaces respectively reachable by only one of the coiling devices.

The severing of the wires or tapes can include positioning at least one cutting device on a side surface of the bale and positioning at least one cutting device under the bale.

Further, the bale can be a cellulose bale.

The present invention is directed to a wire coiling device structured and arranged to perform the above-described wire or tape removal method.

The wire coiling device includes a centrally arranged hollow cylindrical reel rotor having at least two helical slits starting from a work end of the reel rotor that penetrate a cylinder wall, and a stator, enclosing the reel rotor, having at least two helical wire guide slits starting from a work end and running opposite to the slits of the reel rotor, such that the at least two helical wire guide slits being evenly distributed in a circumferential direction. The reel rotor includes a drive shaft formed as a hollow shaft, and a wire ejector is located in the hollow shaft. The at least two helical wire guide slits are rotatably movable relative to the bale in a direction opposite a rotary direction of the reel rotor.

According to the invention, the at least two helical wire guide slits can include at least four guide wire slits.

In accordance with another feature of the present invention, the rotatable relative movement of the at least two helical wire guide slits to the bale can be at least 10° and no more than 99°. Moreover, the rotatable relative movement may be between 10–60°.

Further, the at least two helical wire guide slits can be exactly four wire guide slits.

According to still another feature of the instant invention, the helical wire guide slits can include a wire intake area and a second area, in which the wire intake area is oriented at an angle $\alpha$ that is smaller than an angle $\beta$ at which the second area is oriented.

In accordance with another feature of the invention, seen from a wire intake side, the wire guide slits can have a progressive pitch.

Moreover, the helical wire guide slits may be rounded.

In accordance with still yet another feature of the present invention, the slits of the reel rotor are not rounded.

The present invention is directed to a wire coiling device for removing wires or tapes from pressed bales of raw material. The wire coiling device includes a centrally arranged hollow cylindrical reel rotor having at least two helical slits starting from a work end of the reel rotor that penetrate a cylinder wall and a hollow shaft, and a stator enclosing the reel rotor. The stator has at least four helical wire guide slits starting from a work end and running opposite to the slits of the reel rotor, that are evenly distributed in a circumferential direction. A wire ejector is located in the hollow shaft.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
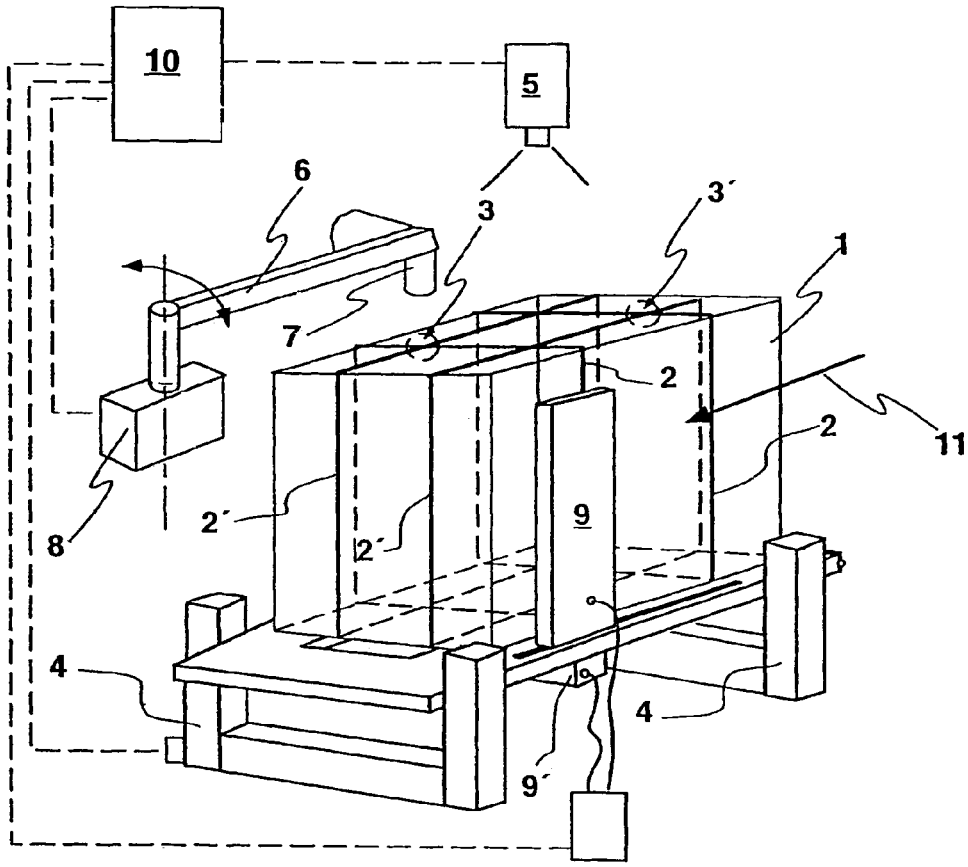
FIG. 1 illustrates an exemplary embodiment for performing the method.

The exemplary embodiment for carrying out the method of the instant invention can be explained very easily on the basis of the representation of FIG. 1. The technical elements are shown so that task and function can be explained. Structural details cannot be learned from this drawing.

The bale 1 shown is positioned so that only approximately vertical wires are present on the lateral surfaces standing vertically. This means that in the position shown here the layering of the bale is horizontal and the press direction is vertical. It is transported into the unwiring station by conveyor devices (not shown), e.g., chain conveyors, roller tracks or apron conveyors, and placed in a position in which the points of intersection 3 and 3' of the wires 2 and 2' are located on the upper side of the bale 1. Then this upper side is brought by the bale positioning device 4 (double lift unit) to a height over which a pivoting arm with telescopic device 6 and wire coiling device 7 swivels in order to remove the wires. With the aid of an intelligent camera 5 which scans the upper side of the bale 1, the positions of the wires are recorded, the points of intersection 3 and 3' are determined and the coordinates transmitted to the machine control unit 10. The drive of the drives for the pivoting device 8 and the telescopic device 6, which move the wire coiling device 7 towards the points of intersection 3 and 3', takes place via the machine control unit 10. Moreover, the position is corrected according to the height deviations of the bale surface from the ideal horizontal plane. If the wire coiling device shown in FIGS. 2*a –c,* 3 and 4 and described later is used, during its positioning a correction is made of the stator point position according to the completed pivot angle of the pivoting device 8 so that the stator points formed by the wire guide slits 17 stand precisely over the sectors that are formed by the wires at the point of intersection 3, 3'. After the correction has been made, the coiling unit is lowered to the bale until the stator points rest on the bale surface. Rotary drives, rack-and-pinion drives and/or hydraulic cylinders which are equipped with position sensors can be used as drives.

At the same time, cutting devices 9 and 9' (merely indicated here), likewise driven by the machine control unit 10, are each brought into a cutting position by linear axes that can be equipped with a servo drive, in which cutting position the severing of the wires 2 and 2' takes place. The cutting sites of the wire are selected such that both ends, seen from the point of intersection 3, are approximately the same length. The cycle rate of the method can also be increased in this manner. Placing the cutting devices on the bales can be carried out by pressure-controlled hydraulic cylinders.

Although this FIG. 1 shows only a single wire coiling device 7 with related pivot arm and telescopic device 6, it is advantageous to provide several of the same. The method works quickest with an unwiring station in which the number of wire coiling devices is sufficient to grip all the wires at the same time. A machine control unit expediently programmed then assigns to each wire coiling device an accessible point of intersection, so that they can work simultaneously. A partial surface of the bale is then accessible for each of the wire coiling devices. As a rule, such bales contain one to four points of intersection on a surface. Expediently, one each such pivot arm with telescopic device 6 is then to be used on both sides of the bale positioning device 4, whereby the two pivoting devices 8 should be arranged diagonally opposite one another.

The cutting devices 9 and 9' can be attached so that they are moved into the vertical together with the bale 1 through the bale positioning device 4. The side from which the cutting devices are brought into the cutting position depends on the space conditions and possibly on the already mentioned desire to obtain ends of the same length with respect to the point of intersection during cutting, if possible. Usually the cutting devices are placed at the side, thus at the surfaces parallel to the bale transport direction (arrow 11). The surfaces standing perpendicular to the transport direction (arrow 11) are not so suitable for reasons of mechanical engineering, which is why the cutting devices are mostly guided to the bales from below for the wires that cannot be gripped from the side.

After all the wires have been removed, the bale 1 can be lowered, e.g., onto a conveyor belt (not shown here) and taken out of the unwiring station in the transport direction (arrow 11). At the same time, this is followed by the new bale that is still wired.

Figure 2A:
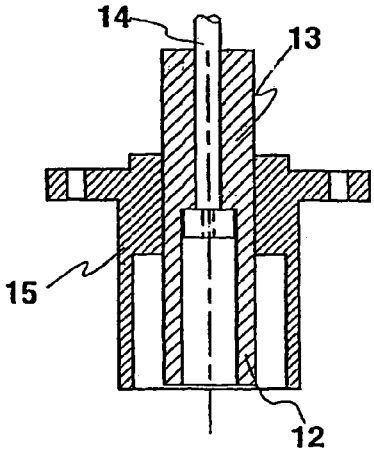
FIGS. 2*a*, 2*b*, and 2*c* illustrate three operating positions of a particularly suitable wire coiling device according to the invention.
Figure 2B:
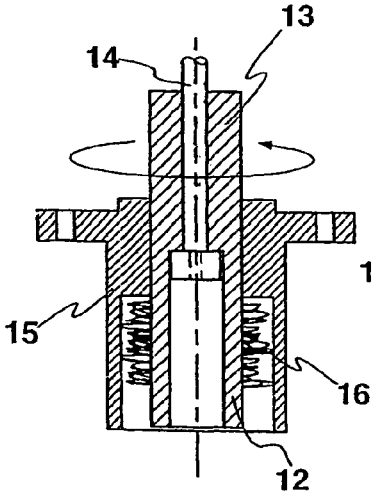
Figure 2C:
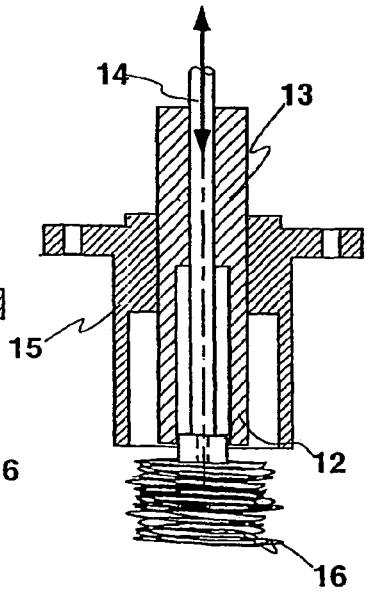

A wire coiling device that is particularly well suited to carrying out the method according to the invention is shown by FIGS. 2*a* through 2*c*. This contains a centrally arranged hollow cylindrical reel rotor 12 with at least two helical slits (not shown here) starting from the work end of the hollow cylinder and penetrating the cylinder wall. This reel rotor 12 is enclosed by a stator 15 which has at least two, preferably four, helical wire guide slits (not shown here) likewise starting from its outer end, running in the opposite direction to the slits of the reel rotor. The hollow cylindrical reel rotor 12 is continued in a drive shaft 13 embodied as a hollow shaft. A wire ejector 14 is located in this hollow shaft. FIG. 2*a* shows the working position before coiling, i.e., the wire ejector 14 is in the initial position. After the wires have been gripped, a wire coil 16 is produced in the stator 15 through the rotation of the reel rotor 12, as FIG. 2*b* shows. The pivoting operation can thereby already start before the wires are completely coiled up, which saves time. FIG. 2*c* shows the wire ejector 14 in the final position of the ejection position, after—moved by a hydraulic or pneumatic cylinder (not shown) with protection against torsion—it has ejected the wire coil 16. At the same time as the ejection operation, a rotational movement of the reel rotor 12 takes place to reduce the friction between the wire coil 16 and the stator 15. Possibilities for removing coiled wires from the wire coiling device 7 are known per se. A distinction should thereby be made between whether these are metallic wires or plastic tapes. In the case of metallic wires, it is favorable to form relatively closely wound coils that can be transported easily. As a relatively clean raw material they should clearly be regarded as a salable product, thus they can be recycled.

Figure 3:
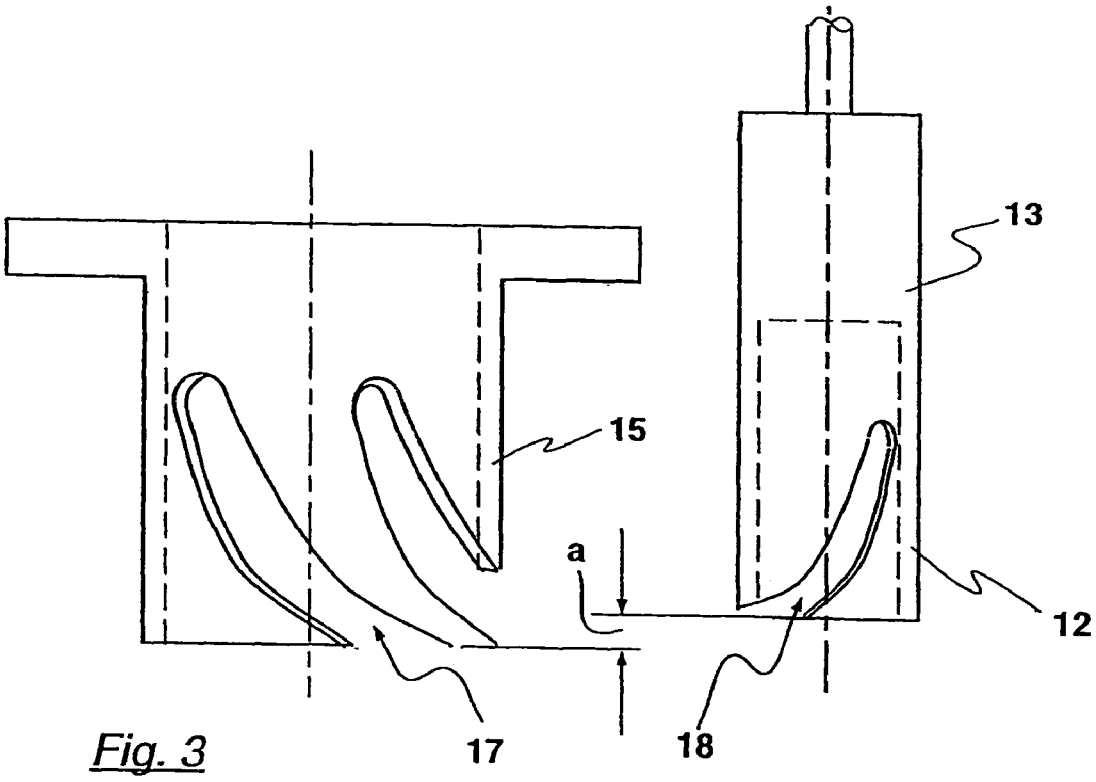
FIG. 3 illustrates parts of the wire coiling device depicted in FIGS. 2*a*–2*c.

A similar wire coiling device is known from DE 28 21 336 C2, already mentioned. The known device is advantageously improved and thus adapted to the method such that the stator can be rotated about its axis in a specific angle range, preferably approx. 30°, in order thus to lift the wires or tapes resting on the bale. FIG. 3 shows on the left a stator 15 and to the right of it the reel rotor 12 with the drive shaft 13. For the sake of improved clarity, these two parts are not drawn in an operative arrangement, thus not connected together. The helical wire guide slits 17 lying at the front and penetrating the cylinder wall are discernible in the stator 15. The slit 18 at the front made in the hollow cylindrical reel rotor 12 is also drawn. The alignment of the slits in these two components is opposite, so that the wires or tapes can be wound up through the rotation of the hollow cylindrical reel rotor 12 inside the stator 15. Since the stator 15 can be rotated in a limited angle range and thus draws the wires from the bale into the wire guide slit 17, a small space a of a few millimeters can be provided between the work end of the reel rotor 12 and the stator 15. This also serves to prevent damage to the bales.

Figure 4:
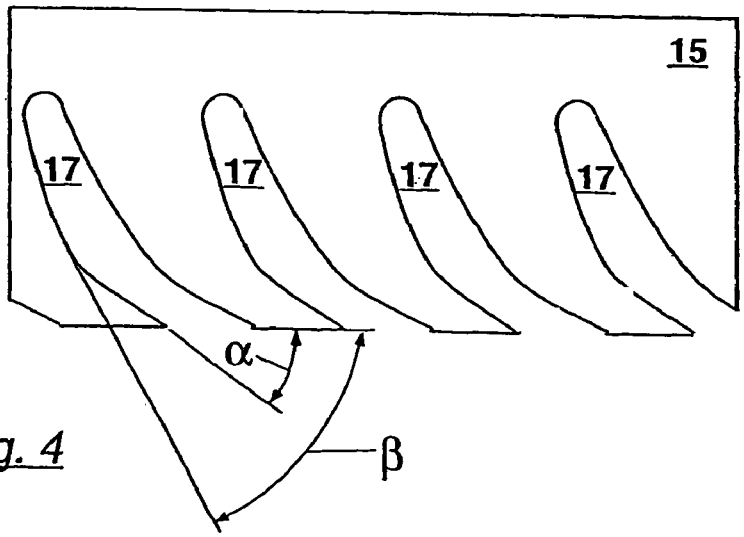
* and FIG. 4 illustrates a developed view of an external cylinder of FIG. 3.

The developed view of the circumference of the stator 15 according to FIG. 4 makes it clear that a total of four wire guide slits 17 are present. Thereby e.g., in the area of the work end, a slit angle $\alpha$ can be selected that is more oblique than the angle $\beta$ in the other area. The wire is thus first lifted particularly easily and later guided reliably upwards into the slit base during the actual coiling operation. The wire guide slit 17 can also be embodied with progressive pitch.

With such a wire coiling device, a wire coil 16 can be formed without the surface of the bale being thereby appreciably damaged. As will be explained below, such damage is undesirable, in particular with high-quality cellulose bales. Since the wire coiling device 7 is guided extremely accurately to the point of intersection, this device is able to securely grip all four wire ends of a point of intersection. The freedom to rotate of the stator 15 can be relatively small. It is normally rotated back to the starting position after the coiling operation has been completed.

Although the method described is fundamentally applicable to bales with different raw materials, e.g., recovered paper, cellulose, linters or cotton, it displays its advantages particularly with the unwiring of cellulose bales. First of all, commercially available cellulose bales are considerably smaller than commercially available recovered paper bales. For the same production, therefore, more cellulose bales have to be opened which leads to a greater demand on the achievable cycle rate. However, it is no less important that the relatively high-quality and expensive cellulose is used where particularly high demands are made on the paper produced. Soiling the outer layer of the bales or damaging the fibers with the cutting and coiling of the bale wires should therefore be avoided. The method according to the invention therefore serves the careful treatment of raw materials in a very special way, since the wire coiling devices and cutting devices are used in a targeted manner at few points. Also the fact that cellulose bales normally are more uniform in their size and wiring form, supports the object of the method, namely to find and remove the wires quickly and easily.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A method for removing wires or tapes from pressed bales of raw material, in which the wires or tapes are arranged to form at least one point of intersection on at least two opposite bale sides, said method comprising:

bringing the bales into an unwiring position;

automatically determining a position of the at least one point of intersection;

positioning a coiling device over the at least one point of intersection;

severing the wires or tapes; and removing the wires or tapes from the bale by coiling the wire or tapes.

2. The method in accordance with claim 1, further comprising transmitting the determined position of the point of intersection to a machine control unit, wherein the machine guide devices guides the coiling device to the point of intersection.

3. The method in accordance with claim 1, further comprising automatically determining the position of the wires or tapes with a wire finder.

4. The method in accordance with claim 1, wherein the bales are brought into the unwiring position via a bale positioning device.

5. The method in accordance with claim 1, wherein the determining of the position of the point of intersection comprises scanning the corresponding side of the bale with an automatic camera.

6. The method in accordance with claim 2, wherein the coiling device is attached to a telescopic device and a pivoting device, which are driven by the machine control unit.

7. The method in accordance with claim 1, wherein the positions of the points of intersection on the upper side of the bale are determined.

8. The method in accordance with claim 1, wherein the wires or tapes are severed by cuffing devices.

9. The method in accordance with claim 8, further comprising positioning the cuffing devices in a cuffing position according to the position of the points of intersection.

10. The method in accordance with claim 9, wherein the culling position is established so that a length of the wires or tapes, starting from the coiling point predetermined from the machine control unit, is approximately the same.

11. The method in accordance with claim 1, wherein two coiling devices are used and the process further comprises dividing an outer surface of the bale into two partial surfaces respectively reachable by only one of the coiling devices.

12. The method in accordance with claim 1, wherein the severing of the wires or tapes comprises positioning at least one cutting device on a side surface of the bale and positioning at least one cuffing device under the bale.

13. The method in accordance with claim 1, wherein the bale comprises a cellulose bale.

14. A wire coiling device structured and arranged to perform a method including bringing the bales into an unwiring position, automatically determining a position of the at least one point of intersection, positioning a coiling device over the at least one point of intersection, severing the wires or tapes, and removing the wires or tapes from the bale by coiling the wire or tapes, the wire coiling device comprising:

a centrally arranged hollow cylindrical reel rotor having at least two helical slits starting from a work end of the reel rotor that penetrate a cylinder wall;

a stator enclosing said reel rotor, said stator having at least two helical wire guide slits starting from a work end and running opposite to said slits of said reel rotor, said at least two helical wire guide slits being evenly distributed in a circumferential direction;

said reel rotor comprising a drive shaft formed as a hollow shaft;

a wire ejector being located in said hollow shaft;

wherein said at least two helical wire guide slits are rotatably movable relative to the bale in a direction opposite a rotary direction of said reel rotor.

15. The wire coiling device in accordance with claim 14, wherein said at least two helical wire guide slits comprises at least four guide wire slits.

16. The wire coiling device in accordance with claim 14, wherein the rotatable relative movement of the at least two helical wire guide slits to the bale is at least 10° and no more than 99°.

17. The wire coiling device in accordance with claim 16, wherein the rotatable reactive movement is between 10–60°.

18. The wire coiling device in accordance with claim 14, wherein said at least two helical wire guide slits are exactly four wire guide slits.

19. The wire coiling device in accordance with claim 14, wherein said helical wire guide slits comprise a wire intake area and a second area, and said wire intake area oriented at an angle ci that is smaller than an angle β at which the second area is oriented.

20. The wire coiling device in accordance with claim 14, wherein, seen from a wire intake side, said wire guide slits have a progressive pitch.

21. The wire coiling device in accordance with claim 14, wherein said helical wire guide slits are rounded.

22. The wire coiling device in accordance with claim 14, wherein said slits of the reel rotor are not rounded.

23. A wire coiling device for removing wires or tapes from pressed bales of raw material, comprising:

a centrally arranged hollow cylindrical reel rotor having at least two helical slits starting from a work end of the reel rotor that penetrate a cylinder wall and a hollow shaft;

a stator enclosing said reel rotor, said stator having at least four helical wire guide slits starting from a work end and running opposite to said slits of said reel rotor, said at least four helical wire guide slits being evenly distributed in a circumferential direction;

a wire ejector being located in said hollow shaft.

* * * * *